United States Patent [19]

Nitta

[11] Patent Number: 5,003,353

[45] Date of Patent: Mar. 26, 1991

[54] ELECTROPHOTOGRAPHIC PRINTER WITH DEVELOPING UNIT EMPLOYING TWO-COMPONENT TONING SYSTEM

[75] Inventor: Koji Nitta, Tokyo, Japan

[73] Assignee: Oki Electric Industry Co., Ltd., Tokyo, Japan

[21] Appl. No.: 347,389

[22] Filed: May 4, 1989

[30] Foreign Application Priority Data

May 10, 1988 [JP] Japan ..... 63-111472

[51] Int. Cl.[5] ..... G03G 15/08; G03G 15/00

[52] U.S. Cl. ..... 355/265; 355/206; 355/246; 355/261

[58] Field of Search ..... 355/245, 246, 261, 265, 355/205, 206, 208, 271

[56] References Cited

U.S. PATENT DOCUMENTS

| | | | |
|---|---|---|---|
| 4,286,866 | 9/1981 | Stelben et al. | 355/270 |
| 4,432,634 | 2/1984 | Tabuchi | 355/246 |
| 4,491,408 | 1/1985 | Savage | 355/265 |
| 4,569,585 | 2/1986 | Masuda | 355/206 |
| 4,755,850 | 7/1988 | Suzuki et al. | 355/265 |
| 4,803,592 | 2/1989 | Ashley | 355/206 X |
| 4,847,657 | 7/1989 | Hanada et al. | 355/218 |

FOREIGN PATENT DOCUMENTS

| | | |
|---|---|---|
| 3140853 | 6/1982 | Fed. Rep. of Germany . |
| 0152462 | 8/1984 | Japan . |
| 0097672 | 5/1986 | Japan . |
| 0140965 | 6/1986 | Japan . |

OTHER PUBLICATIONS

"Xerography", *McGraw-Hill Encyclopedia of Science and Technology*, 6th Edition, vol. 13, pp. 373–377 (1987).

"Electrostatic Processes", *McGraw-Hill Encyclopedia of Science and Technology*, 4th Edition, vol. 10, pp. 158–163 (1977).

*Primary Examiner*—Arthur C. Prescott

*Attorney, Agent, or Firm*—Spencer & Frank

[57] ABSTRACT

A electrophotographic recording apparatus which delays the removal of a potential provided on the developer while the charges on the photosensitive surface are exposed to the developer. The apparatus includes a bias generator controlling which controls the bias generator to apply a potential to the developer continuously for a predetermined period of time which includes the time while the charges on the photosensitive surface are exposed to the developer. The controller further controls the bias generator to apply the potential to the developer during a period immediately before a shutdown of power to the apparatus thereby to prevent carrier particles from adhering to the photoconductor surface until the electric charge on the photoconductor has either dissipated or passed beyond a position adjacent to the developer.

19 Claims, 5 Drawing Sheets

ELECTROPHOTOGRAPHIC PRINTER WITH DEVELOPING UNIT EMPLOYING TWO-COMPONENT TONING SYSTEM

CROSS REFERENCE TO RELATED APPLICATION

The present disclosure relates to the subject matter disclosed in Japanese Patent Application No. 63-111472 filed on May 10th, 1988 the entire disclosure of which is incorporated by reference.

BACKGROUND OF THE INVENTION

The present invention relates to a non-impact printer and, more particularly to a electrographic printer having a developing unit employing a two-component toning system using toner and carrier particles.

The electrographic printer uses the mixture of toner particles and reusable carrier particles for forming the toner particles onto a photoconductor surface thereof. The toner particles that form images are positively or negatively charged, and are statically attracted to the carrier particles which have an opposite charge. The toner and carrier particles are mixed and contained in a container. During the development process, the toner particles are carried by the carrier so as to be wiped across the photoconductor surface. The carrier particles are returned to the container after the transport of the toner particles onto the photoconductor surface. In the developing process of the two-component toning system, it is important to maintain a proper toner-carrier mix in order to produce fine reproduction. During the development process, the carrier particles, however, adhere to the photoconductor surface in a situation in which the power supply to the developing unit is temporarily shut off due to a malfunction of the machine and as a consequence, the volume of carrier particles is reduced to less than the proper volume required to sufficiently carry the toner particles.

Therefore, it is an object of the present invention to maintain a proper toner-carrier mix, especially to prevent the carrier particles from adhering to the photoconductor surface, in order to produce fine reproduction.

SUMMARY OF THE INVENTION

Accordingly, a printer of the invention, in order to prevent carrier particles from adhering to a photoconductor surface of a photoconductor, has a charger, an exposure unit, a container containing toner particles and carrier particles, a developing unit for forming the toner particle onto the photoconductor surface, a bias generator and a bias generator controller for controlling the bias generator. The charger induces electric charges on the charge area of the photoconductor surface so as to establish a first electric potential on the photoconductor surface which retains the electric charge for a significant period of time. The exposure unit forms a latent image within the charged area. The bias generator provides the developing unit with a second electric potential so that the toner particles are significantly attracted to the latent image on the photoconductor surface. Then, the developing unit can apply the toner particles from the container to the photoconductor surface. If the charger stops inducing charge a malfunction of the printer, the bias generator controller has the bias generator continuously provide the developing unit with the second electric potential so as to prevent the carrier particles from adhering to the photoconductor surface during a predetermined period of time, that is, until, either the carrier particles are not significantly attracted to the electric charge or the charge area of the photoconductor passes away from the position adjacent to the developing unit after the charger stop inducing charge.

According to another aspect of the invention, when the printer is actuated by a switch, the bias generator controller has the bias generator preliminary provide the developing unit with the second electric potential so as to prevent the carrier particles from adhering to the photoconductor surface before the charge area is transported into the position adjacent to the developing unit after the switch actuates the printer.

BRIEF DESCRIPTION OF THE DRAWINGS

These and other features and advantages of the invention will be more completely understood from the following detailed description of the preferred embodiments with reference to the accompanying drawings in which.

DETAILED DESCRIPTION OF THE PREFERRED EMBODIMENT

Figure 1:
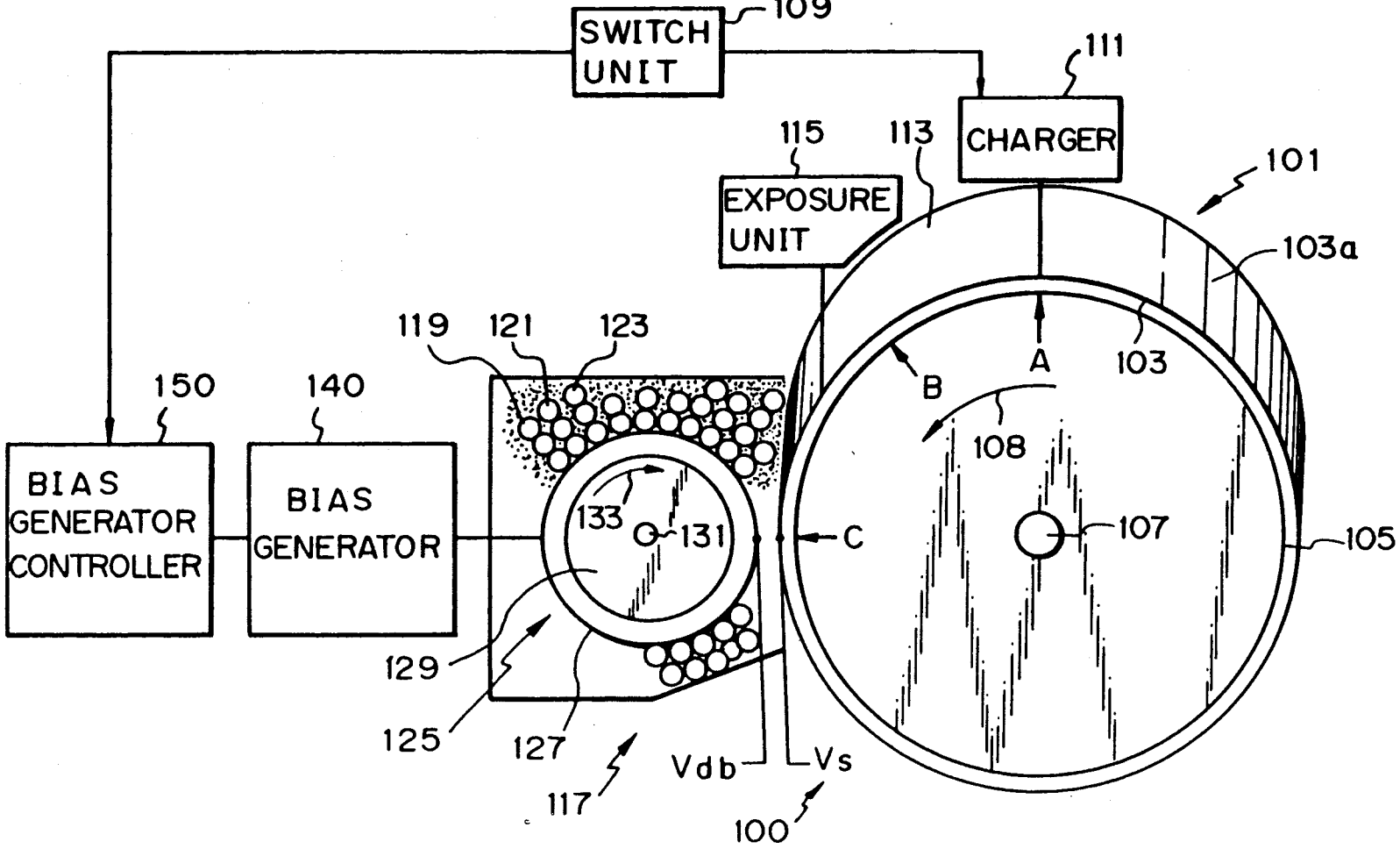
FIG. 1 is a schematic view of a printer 100 in accordance with the present invention.

Referring to FIG. 1, there is illustrated a schematic view of a printer 100 embodying the present invention.

The printer 100 has a photoconductor (photosensitive) drum 101 having a photoconductor layer 103 on a circumferential surface 105 thereof. The photoconductor drum 101 is rotated by a motor 107 in the direction of an arrow 108 when the motor 107 is actuated by a switch unit 109. The switch unit 109 also actuates charger 111 at a predetermined time after the motor 107 is actuated. The switch unit 109 is, in general, coupled to the power source of the printer (not shown) and to superior machines (not shown, e.g. a computer), and provides a bias generator 140 and a bias generator controller 150 with power and control signals in predetermined respective time sequences.

The charger 111 uniformly induces negative electric (electrostatic) charges in an area (charge area) 113, located at a position A adjacent to the charger 111, on the photoconductor surface 103*a* of the photoconductor layer 103. The photoconductor surface 103*a* retains the negative electric charge on the area 113 thereof for a significant period of time if it is not exposed to light. The negative electric charges establishes a predetermined electric potential Vs, for example, negative 600 volts. The negatively charged area 113 on the photoconductor surface 103a is transported by the motor from the position A adjacent to the charger 111 to a position B adjacent to an exposure unit 115.

The exposure unit 115 focuses light onto the negatively charged area 113 so as to form an invisible static latent image corresponding to a print image when the negatively charged area 113 is transported into the adjacent position B of the exposure unit 115, and where light strikes the photoconductor surface 103a the negative electric charges are erased. As a consequence of the exposure, unexposed areas of the negatively charged area. 113 corresponding to the nonimage areas for reproduction ratain the negative electric charges, while the exposed areas form the static latent image having no negative electric charge (0 volt) on the photoconductor surface 103a. The negatively charged area 113 having the static latent image is further transported by the motor 107 from the position B adjacent to the exposure unit 115 to a position C adjacent to a developing unit 117.

The developing unit 117 employs a two-component toning system for toning. In the two-component toning system, toner particles 119, such as black-pigment toner particles, and reusable carrier particles 121 composed of magnetizable materials, are the two components. The toner particles 119 are negatively charged, while the carrier particles 121 having positive charges are mixed with and statically adhere to the toner particles 119 prior to development. The toner particles 119 and carrier particles 121 form a toner-carrier mix within a developer chamber 123 of the developing unit 117. The developing unit 117 further employs a cylindrical development roller 125 comprised of a conductive metal sleeve 127 and a magnetic roller 129 rotatably fitted within, the sleeve 127. The sleeve 127 has applied to it a bias voltage Vdb, for example, negative 450 volts, generated by a bias generator 140 which is controlled by a bias generator controller 150, while the magnetic roller is rotated by a motor 131 in the direction of arrow 133. The circumferential surface of the development roller 125 faces the photoconductor surface 103a and applies the toner particles 119 to the photoconductor surface 103a when the latent image within the negatively charged area 113 is transported therepast. This is because the carrier particles 121 adhering to the toner particles 119 are magnetically attracted to and formed into a brush-like shape by the magnetic roller 129, and that the carrier particles 121 are further rotated along the circumferential surface of the development roller 125 by the rotation of the magnet roller 129, and then wipe the toner particles 119 across the photoconductor surface 103a. When the toner particles 119 adhering to the carrier particles are carried to a position adjacent to the latent image within the negatively charged area 113 the toner particles 119 are significantly electrostatically attracted to the static latent image on the photoconductor surface 103a by a first difference potential (O−Vdb =450 volts) between the electrical potential (0 volt) of the latent image and that (Vdb) of the sleeve 127. Concurrently, the carrier particles 121 are returned to the developer chamber 123 since the attraction of the magnetic roller overcomes a second difference potential (Vs−Vdb = −150 volts) between the electrical potential (Vs) of the charged area 113 and that (Vdb) of sleeve 127.

After the development, the toner particles 119 formed within the negatively charged area 113 are transferred onto a paper (not shown), and then the toner particles 119 are fixed on the paper surface through a fusing process (not shown). Meanwhile, the photoconductor surface 103a is erased, cleaned and returned to the position A adjacent to the charger 111. The motor, photoconductor, charger and exposure unit are not disclosed herein in detail since those are conventional structures, well known to those skilled in the art. For example, such known structures are disclosed in "Xerography", McGRAW-HILL ENCYCLOPEDIA OF SCIENCE & TECHNOLOGY, 6th Edition, Vol. 13, P 373-375, McGRAWHILL BOOK COMPANY (1987) and "Electrostatic processes", McGRAWHILL ENCYCLOPEDIA OF SCIENCE & TECHNOLOGY, 4th Edition, Vol. 10, P 160-161, McGRAW-HILL BOOK COMPANY (1977), which are incorporated herein by reference.

Figure 2:
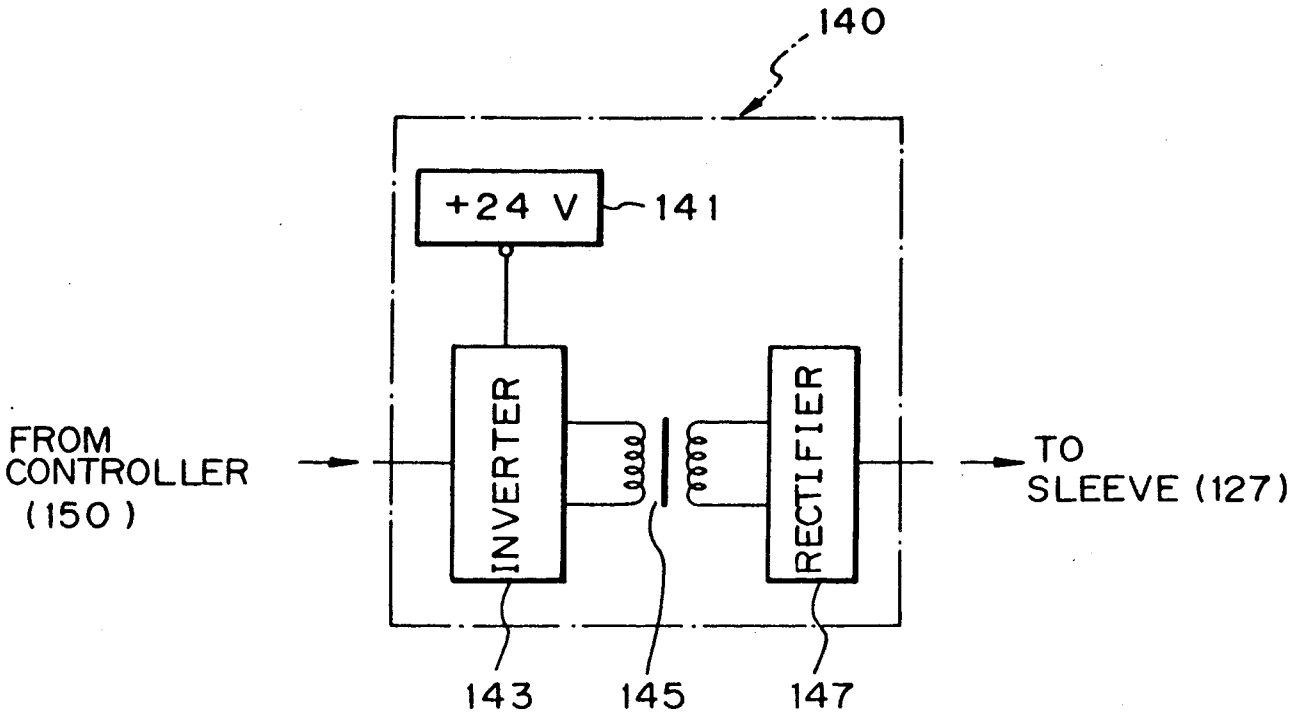
FIG. 2 is a circuit diagram of the bias generator 140 in FIG. 1.

Referring to FIG. 2, there is illustrated in detail the bias generator 140 in FIG. 1.

The bias generator 140 has a direct current (D.C.) power source 141 supplying a D.C. voltage of, for example +24 volts to an inverter 143 controlled by the output of the bias generator controller 150. The inverter 143 is actuated when a low level signal is received from the bias generator controller 150. The inverter 143 converts the received D.C. voltage into alternating current (A.C.) voltage and supplies the A.C. voltage to a boosting transformer 145. The boosting transformer 145 boosts the received A.C. voltage and supplies the boosted A.C. voltage to a rectifier 147. The rectifier 147 converts the boosted A.C. voltage into a D.C. voltage and applies the D.C. voltage as the bias voltage Vdb (−450 volts) to the sleeve 127 shown in FIG. 1.

Figure 3:
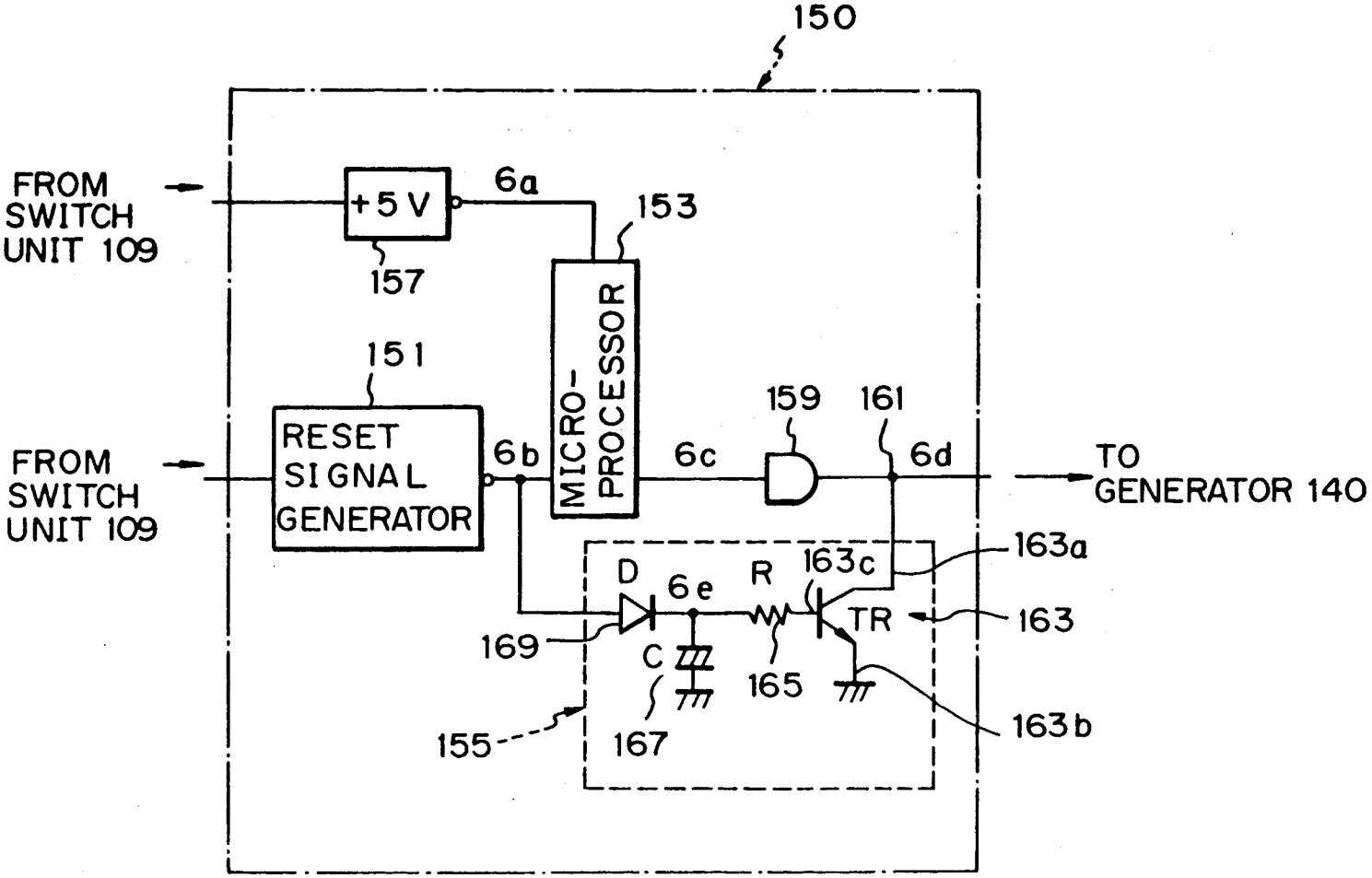
FIG. 3 is a circuit diagram of the bias generator controller 150 in FIG. 1.

Referring to FIG. 3, there is illustrated in detail the bias generator controller 150 of FIG. 1.

The bias generator controller 150 has a reset signal generator 151 for generating a reset signal, i.e., a high level signal, when either the printer 100 is actuated by the switch unit 109 or the printer 100 has ceased printing due to a printer malfunction. The reset signal generator 151 outputs the reset signal to both a microprocessor 153 and an output delaying circuit 155. The microprocessor 153 is a conventional one such as a microprocessor 8032 of the Intel Corporation. The microprocessor 153 is provided with a drive voltage of e.g. +5 volts from a capacitive processor power source 157. The microprocessor 153 continues to output high level signals to a driver 159 during a predetermined period of time from the time of receiving the reset signal and otherwise outputs low level signals. The driver 159, having an output terminal 161, drives the inverter 143 of bias generator 140 (FIG. 2) so as to control the same with the high or low level signals from the microprocessor 153. The output terminal 161 of the driver 159 is also coupled with the output delaying circuit 155.

The output delaying circuit 155 is comprised of a switching transistor 163, a resistor 165, a condenser 167 and a diode 169. The collector 163a of the switching transistor 163 is connected with the output terminal 161 of the driver 159, while the emitter 163b is grounded. The base 163c of the switching transistor 163 is connected with the cathode of the diode 169 through the resistor 165. The cathode of the diode 169 is also connected to one terminal of the condenser 167 whose other terminal is grounded, while the anode of the diode 169 is connected to the output terminal of the reset signal generator 151. When the diode 169 of the output delaying circuit 155 receives the reset signal from the reset signal generator 151, the transistor 163 continues in a conducting (ON) status until the cathode voltage of the diode 169 to applied to the base 163c is below a switching threshold level of the switching transistor 163 at which time the transistor stops conducting. The cathode voltage of the diode 169 is gradually decreased in accordance with the RC time constant of the condenser 167 and the resistor 165. Meanwhile, the microprocessor 153 receives the reset signal and outputs high level signals through the driver 159. The bias generator controller 150, however, is still outputting low level signals until the cathode voltage of the diode 169 is below the switching threshold level since the output terminal 161 of the driver 159 is grounded through the switching transistor 163. Therefore, the bias generator 150 delays outputting high level signals for a predetermined period of time.

Now it will be assumed hereinafter that no output delaying circuit 155 is employed in the bias generator controller 150 in order to fully explain the purpose of the output delaying circuit 155.

Figure 4:
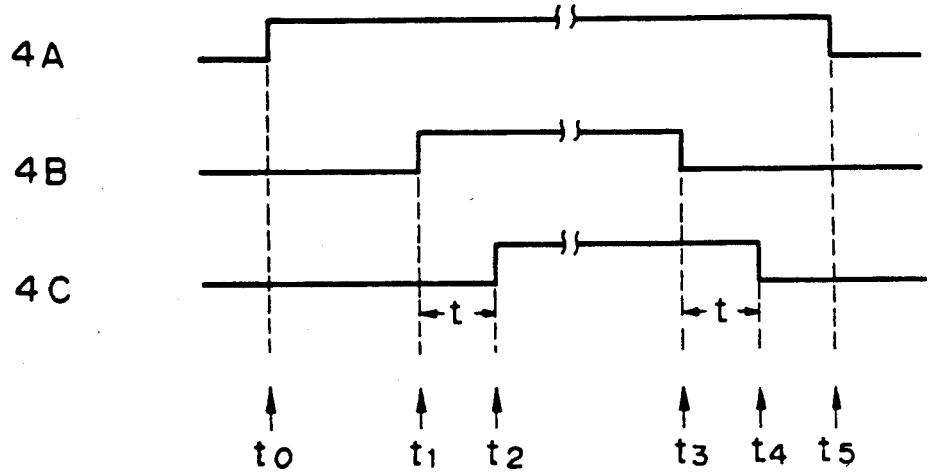
FIG. 4 is a time chart of the operation of the printer 100 concerning the motion of the photoconductor 101, the operating status of the charger 111 and the development roller 125.

As shown in FIG. 1, the charger 111 is positioned above the photoconductor 101 adjacent to and apart from the photoconductor surface 103a, the developing unit 117 also being positioned above and adjacent to the photoconductor surface 103a. It is, therefore, necessary to stagger the timing of applying the bias voltage Vdb to the sleeve 127 by means of the bias generator 140 from the timing of inducing the electric charge on the photoconductor surface 103a by means of the charger 111 by a time interval corresponding to the time of transporting the charged area 113 from the position A adjacent the charger 111 to the position C adjacent to the developing unit 117. In FIG. 4, graphs 4A, 4B and 4C illustrate the foregoing timing control of the charger 111 and developing unit 117. Graph 4A shows the motion of the photoconductor 101 as a function of time wherein a high level portion from time t0 to time t5 represents that the photoconductor is being rotated while the low level portions represent that the photoconductor is stopped. Graph 4B shows the operating status of the charger 111, wherein a high level portion from time t1 to time t3 represents that the charger 111 is inducing electric charges while the low level portions represent that the charger is stopped. Graph 4C shows the operating status of the sleeve 127, wherein a high level portion from time t2 to time t4 represents that the bias voltage Vdb is being applied to the sleeve 127 while the low level portions represent that the bias voltage Vdb is not being applied. The staggered periods of time t1–t2 and t3–t4 are set so as to coincide with the period of time for transporting the charged area 113 on the photoconductor 101 from the position A to the position C as shown in FIG. 1. A problem, however, arises when the printer 100 is malfunctioning.

Figure 5:
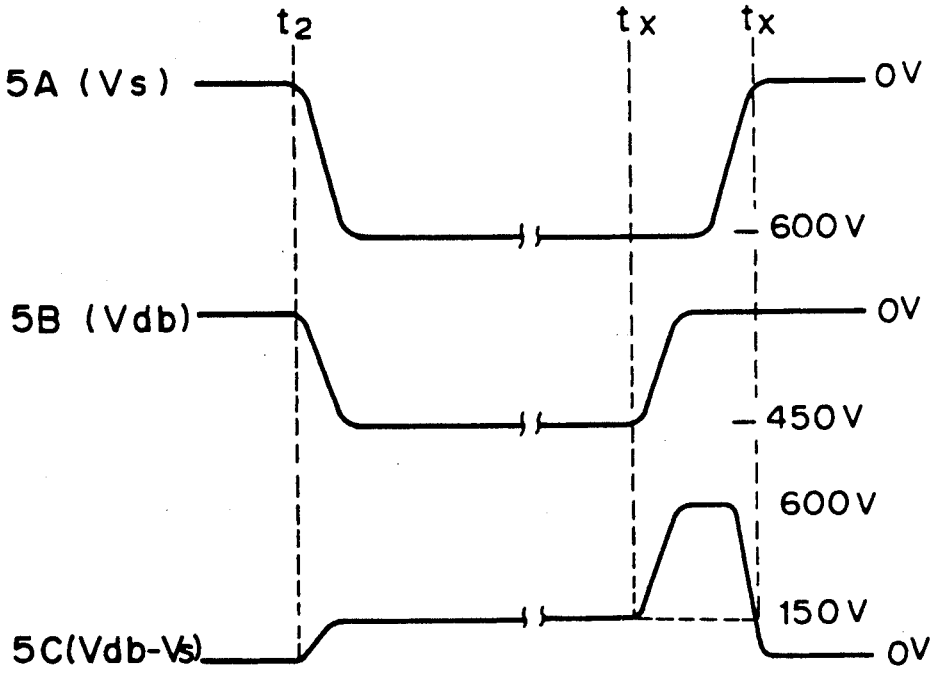
FIG. 5 is graph illustrating the changes in electrical potential Vs of the photoconductor surface 103*a* and the bias voltage Vdb of the sleeve 127, provided that the printer 100 employs no output delaying circuit 155 in the bias generator controller 150 in FIG. 2.

Referring to FIG. 5, there is shown the graphs 5A, 5B and 5C of changes in the electrical potential Vs of the photoconductor surface 103a at the position C adjacent to the developing unit 117 and the bias voltage Vdb of the sleeve 127. Graph 5A shows the change in the electrical potential Vs while graph 5B shows the change in the bias voltage Vdb, and graph 5C shows the change in the difference potential (Vdb−Vs) between the electrical potential Vs and the bias potential Vdb.

When the charged area 113 of the photoconductor surface 103a is transported into the position C at the time t2, the electrical potential Vs of the photoconductor surface 103a at the position C is changed from 0 volt to −600 volts since the photoconductor surface 103a retains the electric charge in the charged area 113 thereon. Meanwhile the bias voltage Vdb is changed from 0 volt to −450 volts at the time Therefore, the difference potential (Vdb−Vs) becomes 150 volts. Now suppose that a malfunction occurs at time tx, as a result of which the charger 111 stops inducing the electric charge and the motor 107 stops driving rotation or the photoconductor drum 101, and also the bias generator 140 stops providing the sleeve 127 with the bias voltage Vdb under the assumption that the output delay circuit 155 has been omitted) as shown in the graph 5B. Under those circumstances the photoconductor surface 103a will still retain the electrical potential Vs in the charged area thereof until time t4 for the charge retaining period the photoconductive layer, as shown in the graph 5A, while the photoconductor drum 101 continues to rotate by inertia. Therefore, when the undeveloped area of the charged area 113 on the rotating photoconductive drum 101 opposes the circumferential surface of the sleeve 127, the second difference potential (Vdb−Vs) suddenly increases to +600 volts and is maintained level at that least until the time t4 as shown in the graph 5C. The second difference potential of 600 volts cause the carrier particles 121 to be strongly attracted to the undeveloped area of the charged area 113 since the attraction of the second difference potential (Vdb−Vs) overcomes that of the magnetic roller 129. As a consequence, the volume of carrier particles 121 in the developer chamber 123 could be depleted level less than the level required to properly carry the toner particles 119, and further, by adhering to the charged area 113 the carrier particles 121 may prevent the toner particles 119 from forming onto the latent image within the charged area 113.

The output delaying circuit 155 is intended to solve this problem by providing the sleeve with the bias voltage Vdb for significant period of time after a machine malfunction in order to prevent the carrier particles 121 from adhering to the photoconductor surface 103a.

Figure 6:
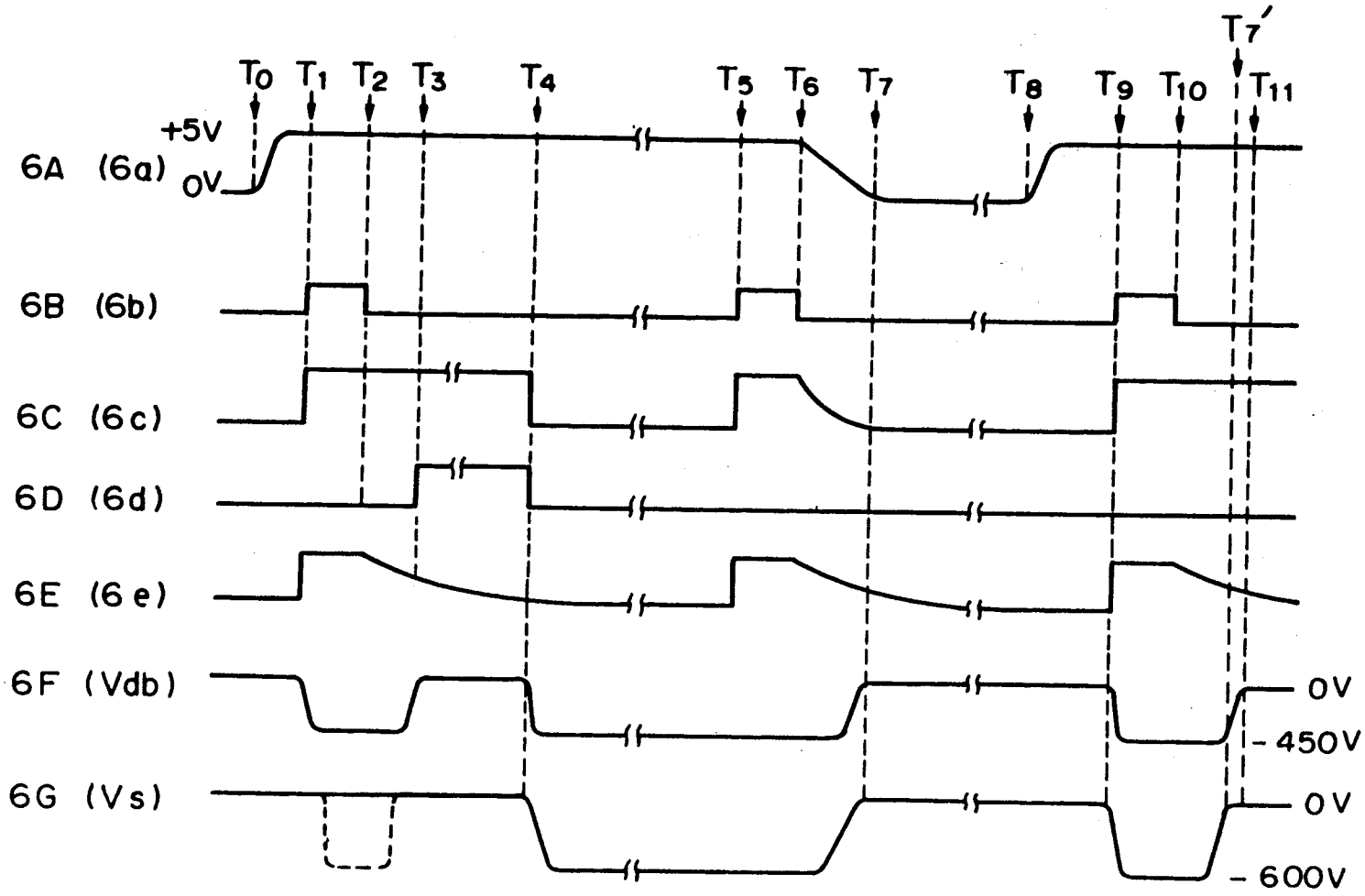
FIG. 6 is graph illustrating the changes in the electrical potential Vs of the photoconductor surface, the bias voltage Vdb of the sleeve 127 and output voltage of other circuits employed in the printer 100.

Referring to FIG. 6, there is illustrated a time chart in the form of graph 6A–6E, of the operation of the embodiment employing the output delaying circuit 155 of FIG. 3. Graph 6A shows changes of an output voltage 6a of the processor power source 157 from 0 volt to 5 volts. Graph 6B shows changes of the output 6b of the reset signal generator 151 wherein high level portions at the periods of time T1–T2, T5–T6 and T9–T10 each represents that the reset signal 6b is generated. Graph 6C shows changes of the output 6c of the microprocessor 153. Graph 6D shows changes of the output 6d of the bias generator controller 150. Graph 6E shows changes of the cathode voltage 6e of the diode 169. Graph 6F shows changes of the bias potential Vdb provided on sleeve 127. Graph 6G shows changes of the electrical potential Vs of the photoconductor surface 103a at the position C adjacent to the developing unit 117.

As shown in the graph 6A, when the switch unit 109 is closed at the time T0, the processor power source 157 supplies and maintains the voltage 6a of 0.5 volts until the switch unit 109 is opened: The reset signal 6b is generated in the period of time T1–T2 after the switch unit 109 is closed. The microprocessor 153 receiving the reset signal 6b outputs high level signals for a predetermined period of time T1–T4, provided that processor power source voltage 6a is supplied. Meanwhile, the cathode voltage 6e of the diode 169 rises to and is into and maintained at a high level within the period of time T1–T2 and gradually decreased in accordance with the predetermined RC time constant of the condenser 167 and the resistor 165, during the period of time T2–T4. When the cathode voltage of the diode 169 falls below the switching threshold level of the switching transistor 163, i.e. at the time T3, the output 6d of the bias generator controller 150 rises to and is maintained at a high level during the period of time T3–T4, provided that the output 6c of the microprocessor 153 is at a high level. The bias voltage Vdb of the sleeve 127 is changed from 0 volt to −450 volts at the time T1 when the switch unit 109 is closed and the output 6d is high. The bias voltage Vdb is maintained at −450 volts until the time T3, that is until the cathode voltage of the diode 169 is below the switching threshold level of the switching transistor 163. The reason for maintaining the bias voltage at −450 volts is to prevent the carrier particles 121 from adhering to undeveloped area portions of the charged area 113 transported past the circumferential surface of the sleeve 127 even if the photoconductor surface 103a is still retaining the previous electric charges, as shown by the dotted line instead of a full line key the graphic 6B of FIG. 6, within the period of time T1–T3, owing to the short time interval between the time of, malfunction in a previous print process and the time T1. Therefore, the RC time constant should be set so that the cathode voltage of the diode 169 is above the switching threshold level of the switching transistor 163 at least until the electrical potential Vs of the photoconductor surface 103a at the position C adjacent to the developing unit 117 is 0 volts.

At the time T4, just before the charged area 113 is to reach position C, the output 6d of the bias generator controller 150 is changed from the high level to the low level since the output 6c of the microprocessor 153 is changed to the low level at the time T4. Then, the bias voltage Vdb of the sleeve 127 is again changed from 0 volt to −450 volts before the, charged area 113 retaining the electric charges at a voltage Vs of −600 volts is transported into the position C adjacent to the developer 117, as shown in the graphs 6F and 6G of FIG. 6. Accordingly, the time period T1–T4 of the high level output of the microprocessor is set so as to finish at least just before the charged area 113 is transported into the position C adjacent to the developing unit 117.

Now suppose that the printing process of the printer 100 is interrupted at time T5 according to a malfunction of the printer 100 and that switch unit 109 is opened. The reset signal 6b is generated in the period of time T5–T6 after the switch unit 109 is opened. The microprocessor 153 receiving the reset signal 6b outputs signals for a predetermined period of time more than the period of time T5–T7. The microprocessor output signal 6c remains high until time T6, but when the input 6b becomes low, output 6c of the microprocessor 153 is gradually decreased as shown graph 6c according to the gradual reduction of the output voltage 6a of the power source 157 which is based on the RC time constant thereof as shown in the graph 6A. Meanwhile, the cathode voltage 6e of the diode 169 rises to and is maintained at the high level within the period of time T5–T6 and then gradually decreases in accordance with the predetermined RC time constant of the condenser 167 and the resistor 165 during the period of time T6–T7. Until the cathode voltage of the diode 169 is below the switching threshold level of the switching transistor 163, i.e. at the time T7, the output 6d of the bias generator controller 150 is maintained at the low level by the cathode voltage 6e. After the time T7, the output 6d of the bias generator controller 150 is still maintained at the low level since the output 6c of the microprocessor 153 is at the low level. Therefore, the bias voltage Vdb of the sleeve 127 can be maintained at −450 volts until the time T7, while the charged area 113 on the photoconductor surface 103a is erased by the self-discharge of the electric charges thereof until time T7, as shown in the graph 6G of FIG. 6.

There is also illustrated in FIG. 6 the operation of the disclosed embodiment in case the switch unit is closed from a time T8 when the photoconductor surface 103a is still retaining the previous electric charges, until a time T7'. The operation of the embodiment at the times T8, T9, T10 and T11 is respectively the same as the operation of the embodiment at the times of T0, T1, T2 and T3, except that the charged area 113 retaining the electric charges at voltage Vs of −600 volts is transported into the position C adjacent to the developer 117 within the period of time T9–T7'. As explained above, the embodiment can prevent the carrier particles 121 from adhering to the undeveloped area of the charged area 113 transported across the circumferential surface of the sleeve 127 since the bias voltage Vdb is maintained at −450 volts within the period of time T9–T11, as shown in the graphs 6F and 6G of FIG. 6.

It will be understood that the above description of the present invention is susceptible to various modifications, changes, and adaptives, and the same are intended to be comprehended within the meaning and range of equivalents of the appended claims. For example, this invention can be applied not only the printing process of negatively inducing the electric charges on the photoconductor surface as explained with respect to the embodiment, but also that of positively inducing the electric charges as described in detail in "Electrostatic processes", McGRAW-HILL ENCYCLOPEDIA OF SCIENCE & TECHNOLOGY, 4th Edition, Vol. 10, P 160–161, McGRAW-HILL BOOK COMPANY (1977).

What is claimed is:

1. An electrophotographic recording apparatus, comprising:

a photoconductor having a photosensitive surface;

means for inducing electric charges on an area of said surface for a first period of time so as to establish a first electric potential at the area, said surface having means for retaining the electric charge for a second period of time;

means for forming a latent image within the area;

storing means for storing a mixture of toner particles and carrier particles;

development means for removing the mixture from said storing means, applying the removed toner particles to said surface, and returning the removed carrier particles to said storing means;

means for exposing the electric charges on the area to said development means during a third period of time which expires after said first period of time, said development means applying the removed toner particles to the area when the charges are exposed to said development means by said exposing means;

second potential applying means for applying a second electric potential to said development means; and means for controlling said second potential applying means to:

(1) apply the second potential to said development means continuously for a predetermined period of time including the third period of time and discontinue the application of the second potential at the end of the predetermined period of time, whereby the toner particles applied by the development means are substantially attracted to the latent image in the area and the carrier particles are prevented by the second potential from adhering to the area by attraction of the exposed charges, and (2) apply the second potential to said development means for a fourth period of time immediately before a shut down of power to the apparatus in response to a signal indicative of and prior to the shut down of power to the apparatus.

2. An electrophotographic recording apparatus as in claim 1, wherein said development means includes a development roller in said storing means, said second potential applying means applying the second potential to said development roller.

3. An electrophotographic recording apparatus as in claim 2, wherein said photoconductor is a photoconductive drum and said photoconductive surface is a cylindrical surface on said drum, said including means and said storing means being spaced along said surface, said exposing means includes means for rotating said drum so as to transport the charges in the area from a position adjacent to said inducing means to a position adjacent to said storing means and said development roller.

4. An electrophotographic recording apparatus as in claim 1, wherein said inducing means and said storing means are spaced from each other along said surface, said exposing means includes means for moving said surface so as to transport the charges in the area from a position adjacent to said inducing means to a position adjacent to said storing means and said development means.

5. An electrophotographic recording apparatus as in claim 1, wherein said second potential applying means comprises a bias generator having an ON conduction in which said bias generator applies the second potential to said development means and an OFF condition in which said bias generator does not apply the second potential to said development means, said controlling means including means, responsive to the signal indicative of a shut down, for generating a reset signal, means, responsive to the reset signal, for turning ON said bias generator and a delay means, responsive to said reset signal for maintaining said bias generator ON throughout the fourth period of time.

6. An electrophotographic recording apparatus as in claim 1, wherein said second potential applying means comprises a bias generator having an ON condition in which said bias generator applies the second potential to said development means and an OFF condition in which said bias generator does not apply the second potential to said development means, said controlling means being responsive to a signal indicative of a startup of power to the apparatus to turn ON said bias generator for a fifth period of time beginning immediately after the startup.

7. An electrophotographic recording apparatus as in claim 6, wherein said controlling means includes means, responsive to the signal indicative of a shut down and the signal indicative of a startup, for respectively generating a first reset signal and a second reset signal, means, responsive to the first reset signal and the second reset signal, for turning ON said bias generator and a delay means, responsive to the first reset signal and the second reset signal, for maintaining said bias generator ON throughout the fourth period of time and the fifth period of time, respectively.

8. An electrophotographic recording apparatus as in claim 1, wherein said second potential applying means comprises a bias generator having an ON condition in which said bias generator applies the second potential to said development means and an OFF condition in which said bias generator does not apply the second potential to said development means, said controlling means including:

means, responsive to the signal indicative of a shut down, for generating a first reset signal, means, responsive to a signal indicative of a startup of power to the apparatus, for generating a second reset signal, and means, responsive to the first reset signal, for turning ON said bias generator and maintaining said bias generator ON throughout the fourth period of time, said turning ON means being further responsive to the second reset signal for turning ON said bias generator and maintaining said bias generator ON throughout a fifth period of time beginning immediately after the startup.

9. An apparatus as in claim 1, wherein said inducing means and said storing means are spaced from each other along said surface, said exposing means includes means for moving said surface so as to transport the charges in the area from a position adjacent to said inducing means to a position adjacent to said storing means and said development means, said second potential applying means comprising a bias generator having an ON conduction in which said bias generator applies the second potential to said development means and an OFF condition in which said bias generator does not apply the second potential to said development means, said second potential applying means being responsive to a first signal to be maintained in the OFF condition, said controlling means including means for generating the first signal, means for applying the first signal to said bias generator and means, responsive to a signal indicative of a startup of power to the apparatus, for preventing application of the first signal to said bias generator during a fifth period of time which said means for generating the first signal is generating the first signal, whereby said bias generator is maintained in the ON condition for the fifth period of time.

10. An apparatus as in claim 9, wherein said means for preventing application of the first signal is further responsive to a signal indicative of the shut down of power to the apparatus to prevent application of the first signal to said bias generator during the fourth period of time while said means for generating the first signal is generating the first signal, whereby said bias generator is maintained in said ON condition for the fourth period of time.

11. An apparatus as in claim 9, wherein said inducing means and said storing means are spaced from each other along said surface, said exposing means includes means for moving said surface so as to transport the charges in the area from a position adjacent to said inducing means to a position adjacent to said storing means and said development means, said second potential applying means comprising a bias generator having an ON condition in which said bias generator applies the second potential to said development means and an OFF condition in which said bias generator does not apply the second potential to said development means, and said second potential applying means being responsive to a first signal to be maintained in the OFF condition, said controlling means including means for generating the first signal, means for applying the first signal to said bias generator and means, responsive to a signal indicative of application of the charge to the area by said inducing means, for preventing application of the first signal to said bias generator during the predetermined period of time, while said means for generating the first signal is generating the first signal, whereby said bias generator is maintained in the ON condition for the predetermined period of time.

12. An apparatus as in claim 11, wherein said means for preventing is further responsive to a signal indicative of the shut down of power to the apparatus for preventing application of the first signal to said bias generator during the fourth period of time, while said means for generating the first signal is generating the first signal, whereby said bias generator is maintained in the ON condition for the fourth period of time.

13. An apparatus as in claim 12, wherein said means for preventing is further responsive to a signal indicative of a startup of power to the apparatus for preventing application of the first signal to said bias generator during the fifth period of while said means for generating the first signal is generating the first signal, whereby said bias generator is maintained in the ON condition for the fifth period of time.

14. An electrophotographic recording apparatus, comprising:

a photoconductive having a photosensitive surface;

means for inducing electric charges on an area of said surface for a first period of time so as to establish a first electric potential at the area, said surface having means for retaining the electric charge for a second period of time;

means for forming a latent image within the area;

means for storing a mixture of toner particles and carrier particles;

development means for removing the mixture from said storing means, applying the removed toner particles to said surface, and returning the removed carrier particles to said storing means;

means for exposing the electric charges on the area to said development means during a third period of time which expires after the first period of time, said inducing means and said storing means being spaced from each other along said surface, said exposing means including means for moving said surface so as to transport the charges in the area from a position adjacent to said inducing means to a position adjacent to said storing means, said development means applying the removed toner particles to the area when the charges are exposed to said development means by said exposing means;

a bias generator having an ON condition in which said bias generator applies a second potential to said development means and an OFF condition in which said bias generator does not apply the second potential to said development means; and controlling means for turning said bias generator ON and OFF to:

(1) apply the second potential to said development means continuously for a predetermined period of time including the third period of time and discontinue the application of the second potential at the end of the predetermined period of time, whereby the toner particles applied by the development means are substantially attracted to the latent image in the area and the carrier particles are prevented by the second potential from adhering to the area by attraction of the exposed charges, and (2) apply the second potential to said development means for a fourth period of time immediately before a shut down of power to the apparatus in response to a signal indicative of and prior to the shut down, said controlling means including a microprocessor, responsive to a signal indicative that said inducing means has begin inducing electric charges on the area, for applying a first control signal to the bias generator to turn said bias generator ON for the pre-determined period of time and then turn said bias generator OFF, a reset signal generator, responsive to a signal indicative of a shut down of the apparatus, for generating a reset signal, and means, responsive to the reset signal, for applying a second control signal to the bias generator to maintain the bias generator ON for the fourth period of time.

15. An apparatus as in claim 14, wherein said reset signal generator is further responsive to a signal indicative of a startup of power to the apparatus to generate the reset signal, said means for applying the second control signal including means for applying a third control signal to the bias generator to maintain the bias generator ON for a fifth period of time immediately after the startup.

16. An apparatus as in claim 14, wherein said means for applying the second control signal includes a delaying circuit having an input coupled to an output of said reset signal generator and an output coupled to an input of said bias generator.

17. An apparatus as in claim 16, wherein said delaying circuit includes a resistor and a condenser, defining an RC time constant of said delaying circuit.

18. A method of forming toner particles on a photoconductive surface of an electrophotographic recording apparatus, comprising the steps of:

including electric charges on an area of the photoconductive surface with a charger for a first period of time so as to establish a first electric potential at the area, the surface retaining the electric charge for a second period of time;

forming a latent image within the area;

storing a mixture of toner particles and carrier particles in a storage unit at a location spaced from the charger;

removing the mixture from the storage unit;

applying the removed toner particles to the surface with an applicator adjacent to the storage unit;

returning the removed carrier particles to the storage unit;

transporting the area from the charger to the applicator and exposing the electric charges on the area to the applicator during a third period of time which expires after the first period of time, applying the toner particles removed from the storage unit to the area when the charges are exposed to the applicator;

transporting the area and the charges thereon away from the applicator; and applying a second electric potential to the applicator continuously for a predetermined period of time which includes the third period of time, whereby the toner particles applied by the applicator are substantially attracted to the latent image in the area and the carrier particles are prevented by the second potential from adhering to the area by attraction of the exposed charges, and further applying the second electric potential to the applicator in response to a signal indicative of and prior to a shut down of power to the apparatus, for a fourth period of time immediately before the shut down, whereby the second electric potential is applied to the applicator until after the area and the charges thereon have been transported away from the applicator.

19. A method as in claim 18, further comprising the step of further applying the second electric potential to the applicator in response to a signal indicative of a startup of power to the apparatus, for a fifth period of time immediately after the startup.

* * * * *